US005256461A

United States Patent [19]

Johnson

[11] Patent Number: 5,256,461

[45] Date of Patent: Oct. 26, 1993

[54] COLLAPSIBLE FLOWER POT AND CHRISTMAS TREE STAND COVER

[76] Inventor: Kevin P. Johnson, 3923 Merced, Des Moines, Iowa 50310

[21] Appl. No.: 862,302

[22] Filed: Apr. 2, 1992

[51] Int. Cl.[5] ..... B32B 3/10; B32B 3/06

[52] U.S. Cl. ..... 428/55; 428/99; 428/34.1; 47/72

[58] Field of Search ..... 428/55, 27, 99, 34.1; 47/28.1, 72; 217/51, 17

[56] References Cited

U.S. PATENT DOCUMENTS 373,828 11/1887 Hamilton ..... 217/51

1,393,591 10/1921 Walter ..... 217/51

FOREIGN PATENT DOCUMENTS 318155 12/1956 Switzerland ..... 47/72

*Primary Examiner*—Alexander S. Thomas

*Attorney, Agent, or Firm*—Zarley, McKee, Thomte, Voorhees & Sease

[57] ABSTRACT

A collapsible cover or enclosure is provided for surrounding a flower pot, Christmas tree stand or the like. The cover includes a plurality of slats connected to one another by adhesive tape so as to form a flexible sheet of interconnected slats. The sheet is foldable from a relatively flat storage and shipping configuration to a three-dimensional geometrically shaped for surrounding the flower pot or tree stand. An expansion ring holds the sidewall in the desired shape. A lid having an opening therein through which the plant or tree trunk extends is removably mounted on the top of the sidewall.

13 Claims, 2 Drawing Sheets

COLLAPSIBLE FLOWER POT AND CHRISTMAS TREE STAND COVER

BACKGROUND OF THE INVENTION

Plants are often potted in inexpensive, non-decorative pots so that the owner can re-pot the plant in a different decorative or ornamental pot of his or her selection. However, such re-potting of the plant is messy, time consuming and may damage the plant. Decorative pots often are made of breakable material, such as ceramic, which requires careful handling, shipping and storage of the pots. Also, such pots are often expensive, due to the materials and craftsmanship which go into the manufacturing of the pots. Even inexpensive pots present storage and shipping problems due to their size and shape.

Christmas trees, both real and artificial, are normally placed in a tree stand which holds the tree is an upright position. The tree stand typically has three or four diverging legs, and is often covered with a tree skirt to provide a decorative appearance. The tree skirt can become wrinkled during storage, and is subject to damage during storage caused by mice, moths and the like.

Accordingly the primary objective of the present invention is the provision of a collapsible flower pot and Christmas tree stand cover.

Another objective of the present invention is the provision of a pot or stand cover which is economical to manufacture, collapsible for compact shipping and storage, and durable in use.

Another objective of the present invention is the provision of a collapsible enclosure which is movable between a substantially two-dimensional shape and a three-dimensional shape.

Still another objective of the present invention is the provision of a collapsible cover which is ornamental, decorative, and aesthetically pleasing.

These and other objectives will become apparent from the following description of the invention.

SUMMARY OF THE INVENTION

A collapsible cover or enclosure is provided for surrounding a potted plant, a Christmas tree stand, or the like. The cover includes a plurality of slats positioned adjacent one another and connected by flexible adhesive tape so as to form a flat, flexible sheet of interconnected slats. The opposite ends of the sheet can be releasably secured together so as to form a three-dimensional enclosure having a substantially continuous sidewall adapted to surround the flower pot or Christmas tree stand. A lid is removably fit onto the top of the sidewall, and includes an opening through which the plant or tree extends. The lid is formed by at least two pieces so as to fit around the plant or tree trunk. An expansion ring fits within the sidewall of the enclosure so as to maintain the enclosure in the three-dimensional shape.

DETAILED DESCRIPTION OF THE DRAWINGS

Figure 3:
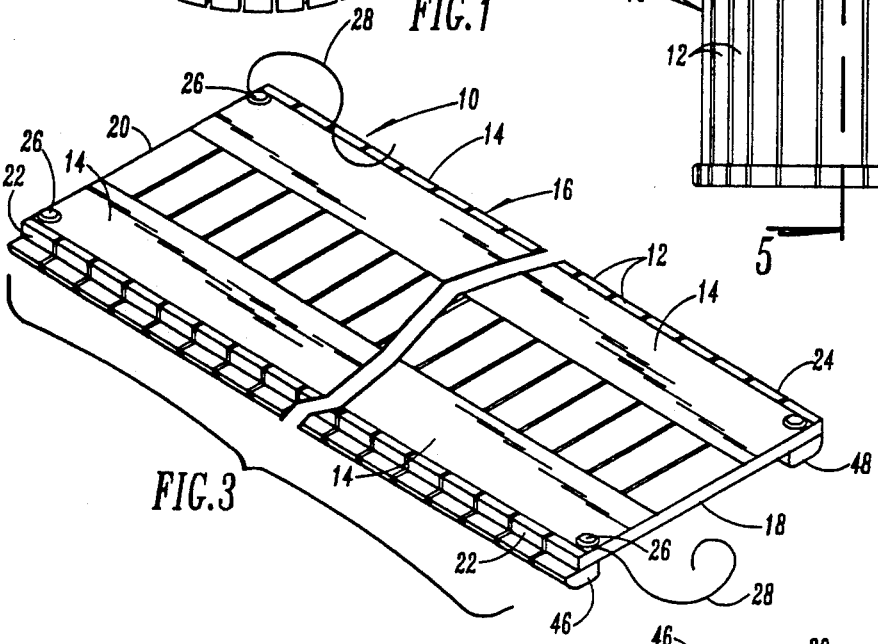
FIG. 3 is a sectional view showing the sheet of interconnected slats in a flat orientation.

The collapsible cover or enclosure of the present invention is generally designated in a drawings by the reference numeral 10. Cover 10 is formed by a plurality of wooden slats or staves 12 closely spaced to one another. Slats 12 are secured to one another by a flexible membrane 14 connected to each of the slats so as to form a flexible sheet 16 of interconnected slats, as seen in FIG. 3. Membrane 14 is preferably fiberglass reinforced adhesive tape. The tape can be heated, with an iron or the like, such that the adhesive penetrates the pores of wooden slats 12. One example of a commercially available tape is manufactured by Nashua Tape of Watervliet, N.Y. 12182. As an alternative to fiberglass tape, canvas or similar material can be glued on to the slats 12 so as to form sheet 16.

Figure 4:
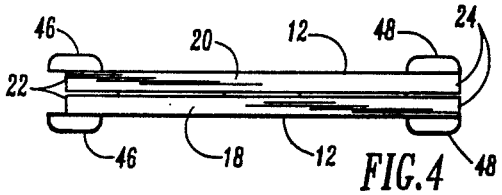
FIG. 4 is an end view showing the sheet in a folded position.

The flexibility of material 14 allows sheet 16 to be folded in half, as shown in FIG. 4, or to be formed into any desired shape, as described below. The drawings show enclosure 10 to be formed into a circle, in cross section, though it is understood that other geometric shapes may be formed, such as an oval, square, rectangle, triangle, hexagon or octagon.

Figure 5:
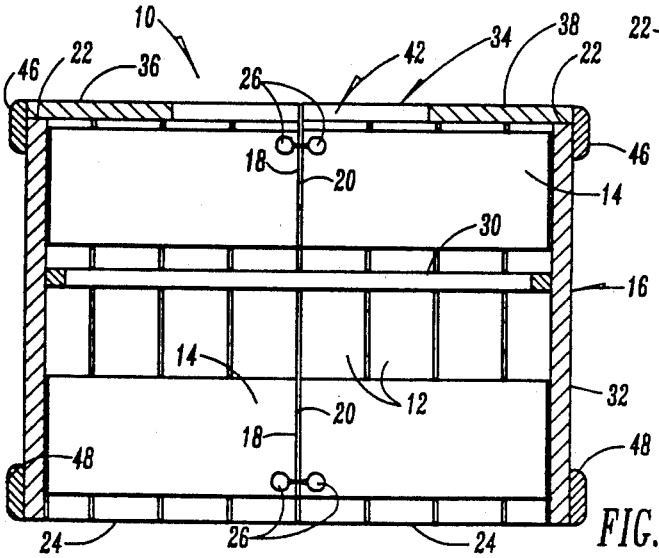
FIG. 5 is a sectional view taken along lines 5—5 of FIG. 2.

Sheet 16 has opposite ends 18, 20 with upper and lower edges 22, 24, respectively. A pin 26 is mounted on the internal side of sheet 16 adjacent each corner thereof, as best seen in FIG. 3. A pair of strings or wires 28 are secured to two of the pins 26 and is adapted to be wrapped around the pins in a figure-8 pattern so as to secure the opposite ends 18, 20 of sheet 16 together, as seen in FIG. 5, thereby forming a sidewall 32 of the cover 10.

Figure 6:
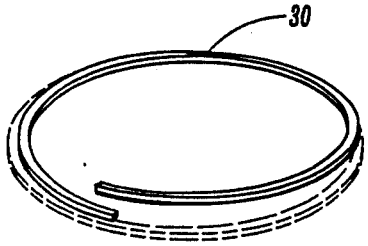
FIG. 6 is a perspective view of the internal expansion ring.
Figure 7:
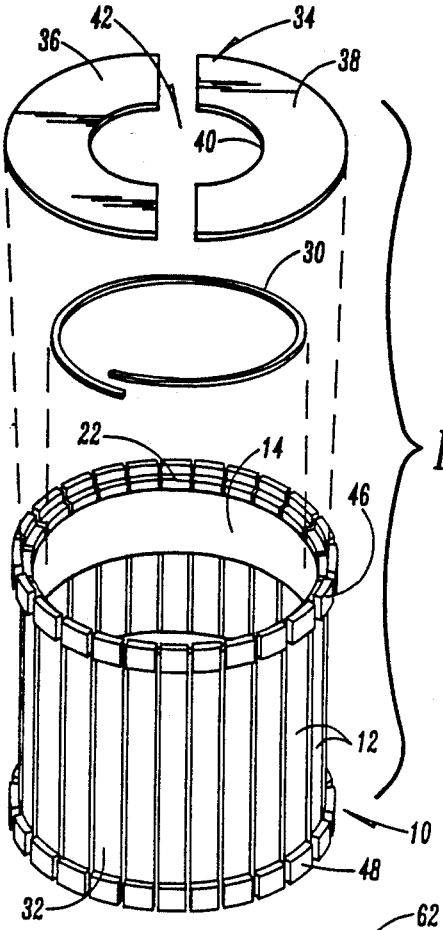
FIG. 7 is an exploded perspective view of the collapsible cover of the present invention.

An expansion ring 30 fits within sidewall 32 formed by sheet 16 so as to maintain the sidewall in the desired geometric shape. In the drawings, ring 30 is shown to be circular, though other geometrically shaped rings can be used to form sidewall 32 into the desired geometric shape. Ring 30 has a normal diameter, as shown by dotted lines in FIG. 6. Ring 30 can be compressed to a slightly smaller diameter, as shown by solid lines in FIG. 6, so as to fit within sidewall 32 and is then released so as to expand into frictional engagement with the inside surface of sidewall 32. Thus, the flexible sidewall is rigidly maintained in the desired geometric shape.

Figure 1:
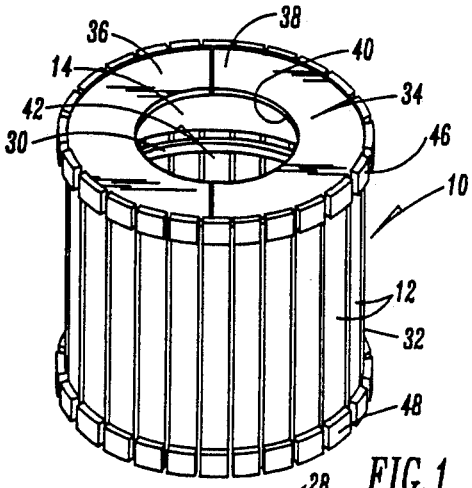
FIG. 1 is a perspective view of the collapsible cover of the present invention.
Figure 2:
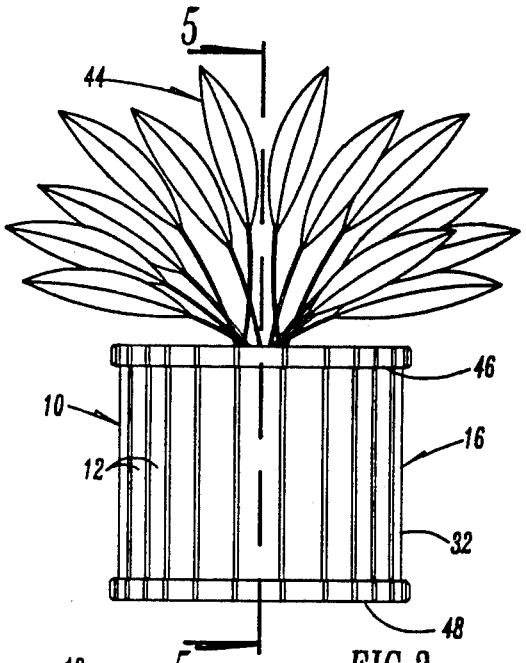
FIG. 2 is an elevational view of the cover shown in position on a potted plant.

A lid 34 rests upon upper edge 22 of sidewall 32. Lid 34 is made of at least two pieces 36, 38, as best seen in FIG. 1. Each lid piece 36, 38 has a notch or cut-out section 40 which cooperatively define an opening 42 through which a plant 44 extends. A plurality of retainer members 46, in the form of a decorative trim, may be glued or otherwise secured to slats 12 so as to extend above upper edge 22. Members 46 maintain lid sections 36, 38 in position on the top of sidewall 32. A decorative trim 48 may also be added elsewhere along the slats, as shown adjacent edge 24 of sidewall 32 in the drawings.

In manufacturing cover 10, elongated strips of trim are glued to a solid piece of wood or plywood, which is then cut into slats 12 with the pieces 46, 48 of trim attached thereto.

Figure 8:
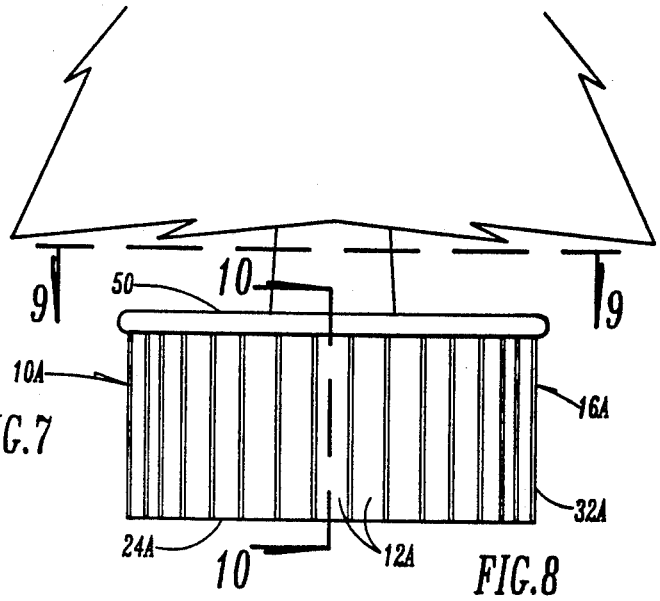
FIG. 8 is an elevational view of an alternative embodiment of the collapsible cover of the present invention.
Figure 9:
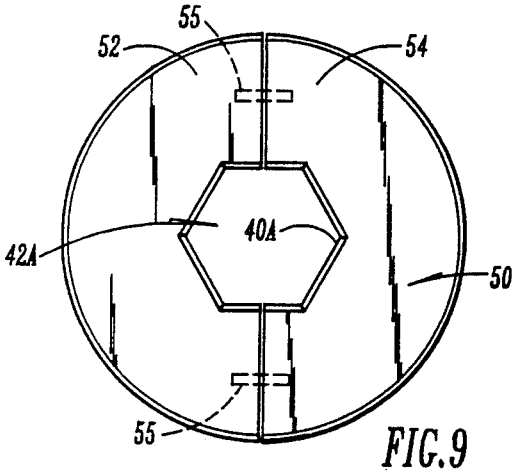
FIG. 9 is a top plan view taken along lines 9—9 of FIG. 8.
Figure 11:
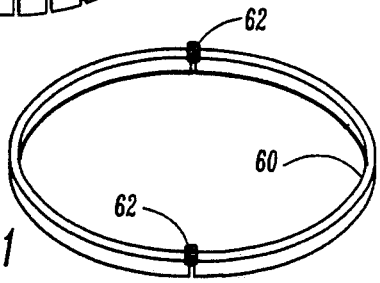
FIG. 11 is a perspective view of the internal ring of the embodiment of FIG. 8.
Figure 10:
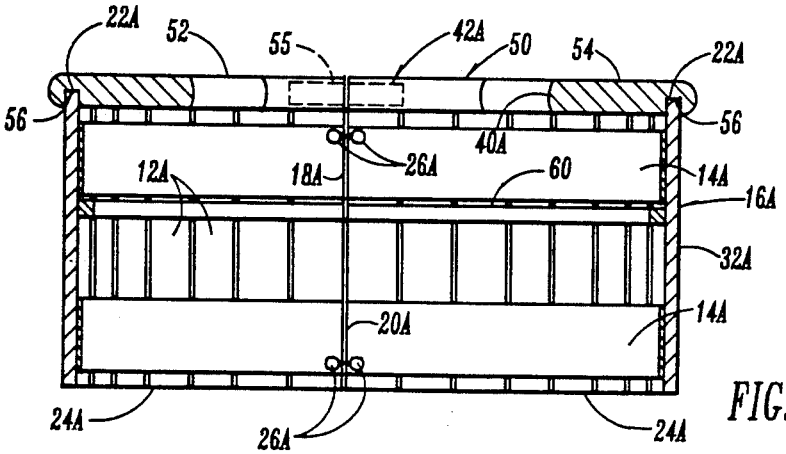
FIG. 10 is a section view taken along lines 10—10 of FIG. 8.

An alternative embodiment of the invention is shown in FIGS. 8–10. The structure of the alternative enclosure 10A is substantially identical to that described above with respect to cover 10 shown in FIGS. 1–7. Enclosure 10A includes a plurality of slats 12A connected together by a flexible tape or membrane 14A so as to define a sidewall 32A. Sidewall 32A is movable between a substantially two-dimensional flat sheet for shipping and storage and a three-dimensional piece for enclosing a flower pot or Christmas tree stand, as described above. A lid 50, comprised of at least two sections 52, 54 includes a groove 56 adapted to matingly receive upper edge 22A of sidewall 32A, as seen in FIG. 10. A pair of dowels 55 secured in the edge of one section 52 or 54 are received in a mating hole in the edge of the other section so as to keep the lid sections coplanar. Decorative trim 46 is not utilized on enclosure 10A, since groove 56 keeps lid 50 in position on the sidewall. Lid 50 includes an opening 42A through which the trunk of a Christmas tree 58, or the like, extends. Ring 60 includes two halves hinged together by hinges 62, so that the ring can be folded for storage and shipping. Ring 60 is held in position within sidewall 32A by a close tolerance friction fit.

The enclosures 10, 10A of the present invention are collapsible from the three-dimensional use position to a substantially flat two-dimensional position for storage and shipping. The lids 34, 50 eliminate the need to provide decorative fill material, such as colored glass or stone in the flower pot. The enclosures are easy to assemble without tools and provide a clean aesthetic appearance while hiding the flower pot or tree stand. Furthermore, the enclosure can be custom made to any desired dimension.

It is understood that the precise structure of the enclosures of the present invention can be modified without departing from the scope of the present invention. For example, pins 26 and string or wire 28 can be replaced with a clasp or other fastener. Notches 40, 48 can be eliminated from lids 34, 50A, respectively such that the lid is solid, thereby creating a collapsible end table.

From the foregoing, it can be seen that the present invention accomplishes at least all of the stated objectives.

What is claimed is:

1. A collapsible cover for surrounding a flower pot, Christmas tree stand, or other object, comprising:

a plurality of slats positioned adjacent one another;

means for connecting adjacent slats so as to form a flexible sheet of interconnected slats, the sheet having opposite ends;

fastening means for releasably securing the opposite ends of the sheet together so as to form a sidewall adapted to surround the pot, stand, or other object, the sidewall having opposite inside and outside surfaces and opposite upper and lower edges;

a lid removably mounted on the upper edge of the sidewall and having an opening through which the plant, tree or the like extends;

the sheet be selectively movable between a flat storage position and an upright enclosing position, and ring means for maintaining the sidewall in the enclosing position.

2. The cover of claim 1 wherein the ring means is flexible so as to compressibly fit within the sidewall, and expandably frictionally engage the inside surface of the sidewall.

3. The cover of claim 1 wherein the means for connecting the slats is an elongated membrane secured to each slat.

4. The cover of claim 3 wherein the membrane is adhesively secured to the slots.

5. The cover of claim 1 wherein the lid is formed by at least two separate pieces positioned adjacent one another on the upper edge of the sidewall.

6. The cover of claim 5 wherein each piece of the lid includes a notch, the notches being oriented when the lid is assembled so as to define the opening therein.

7. The cover of claim 1 wherein the lid includes a top side and a bottom side, the bottom side having a groove for receiving the upper edge of the sidewall so as to hold the lid in position on the sidewall.

8. The cover of claim 1 further comprising retainer means for holding the lid in position on the upper edge of the sidewall.

9. The cover of claim 8 wherein the retainer means includes of plurality of trim members each being connected to a slat and extending above the upper edge of the sidewall.

10. The enclosure of claim 8 wherein the retaining means is a plurality of extension members extending above the upper edge of the sidewall so that the lid is mounted between the extension members.

11. The enclosure of claim 8 wherein the retaining means is a groove in the lid for matingly engaging the upper edge of the sidewall.

12. The enclosure of claim 1 wherein the ring means fits within the sidewall.

13. The enclosure of claim 12 wherein the ring means is flexible.

* * * * *